US006448705B1

(12) United States Patent
Chen et al.

(10) Patent No.: US 6,448,705 B1
(45) Date of Patent: Sep. 10, 2002

(54) STRUCTURE OF A VACUUM DISPLAY DEVICE

(75) Inventors: Lai-Cheng Chen, Taipei; Chun-Hui Tsai, Hsinchu; Shih-Hsien Lin, Hsinchu Hsien; Ruey-Feng Jean, Tainan, all of (TW)

(73) Assignee: Delta Optoelectronics, Inc., Hsinchu (TW)

( * ) Notice: Subject to any disclaimer, the term of this patent is extended or adjusted under 35 U.S.C. 154(b) by 18 days.

(21) Appl. No.: 09/654,809

(22) Filed: Sep. 5, 2000

(30) Foreign Application Priority Data

Oct. 6, 1999 (TW) ..... 088117224 A

(51) Int. Cl.[7] ..... H01J 29/70

(52) U.S. Cl. ..... 313/422; 313/477 R; 313/292

(58) Field of Search ..... 313/422, 477 R, 313/482, 495, 583, 238, 292

*Primary Examiner*—Vip Patel
(74) *Attorney, Agent, or Firm*—J.C. Patents

(57) ABSTRACT

A structure of a vacuum display device is mainly constructed in a vacuum chamber, which is formed by the enclosure of a surface plate, a base plate, and a spacer plate. The surface plate includes a display matrix and a black matrix, the base plate includes an inner surface and an outer surface, while the spacer plate possesses a plurality of recesses in its edges. The required electrode lead wires are disposed on the inner surface of the base plate and are extended out through the recesses. A plurality of fins are disposed on the spacer plates to support the surface plate, the base plate, and the spacer plate, and are located at the black matrices. Additionally, sealing material is used to seal the connections between the surface plate, the base plate, and the spacer plate, and is also used to fill the gaps in the recesses.

25 Claims, 4 Drawing Sheets

STRUCTURE OF A VACUUM DISPLAY DEVICE

CROSS-REFERENCE TO RELATED APPLICATION

This application claims the priority benefit of Taiwan application serial no. 88117224, filed Oct. 6, 1999.

BACKGROUND OF THE INVENTION

1. Field of the Invention

This invention relates to a structure of a vacuum display device, and more particularly to a reinforced structure to strengthen the structure of a high voltage vacuum fluorescent display (HVVFD), and a reinforced structure to strengthen the structure of a high voltage vacuum fluorescent electrode.

2. Description of Related Art

The vacuum device has been a very popular product in the market for a long time. Its range of application is very wide, for example, display devices, stereos, etc. Display devices with high luminosity have been widely used in many situations for forwarding information, for instance, a scoreboard in a stadium, an electronic digital display in a public area, a bulletin board on highway for showing directions and road conditions, etc. The display screen used in a large electronic digital display is a display technology consisting of many small light-emitting devices. Today, such small light-emitting devices include incandescent light bulbs, small cathode ray tubes (CRT), high voltage vacuum fluorescent displays (HVVFD), small fluorescent lamps, and light-emitting diodes (LED). Among these five light-emitting devices, CRT, HVVFD and LED can be used in a large screen for displaying animated color images.

CRT uses an electron beam to bombard a fluorescent powder which then emits light. This method of emitting light is very efficient. An electron gun is used to generate the electron beam, wherein the electron beam is generated by heating beryllium oxide, strontium, and calcium coated on a metal. The heating excites the electrons which then are accelerated by being passed through an electron lens. A high degree of vacuum state must be maintained in the cathode ray tube since air molecules would retard the efficiency of the bombardment from the electron gun and the free ions generated by the bombardment would damage the electron gun. In order to maintain the high degree of vacuum state, the glass from which the tube is fabricated must have a certain thickness so as to be strong enough to sustain the atmospheric pressure. At the same time, since the electron gun is a kind of point electron source that makes use of a scanning method to bombard the fluorescent powder, the larger the screen, the longer a distance between the gun and the screen must be. For this reason, the CRT is usually bulky and heavy. FIG. 1 is a perspective view of a high voltage vacuum fluorescent display (HVVFD) according to the prior art. HVVFD 100 uses a line electron source 102, as opposed to the point electron source used in a CRT. Since the line electron source 102 uses a tungsten filament coated with oxide that emits a lot of thermoelectrons for bombarding the fluorescent powder, the disadvantage of the CRT being too bulky can greatly be improved thereby. At the same time, since HVVFD 100 can coat the three original colors, red, green and blue, on one light-emitting unit 104, it is easier to combine into a color display screen. In comparison with a small CRT, the resolution of the HVVFD is also higher. The line electron source 102 emits thermoelectrons, which pass through the gate 106 to be accelerated, and finally bombard the light-emitting unit 104. The line electron source 102, gate 106 and light-emitting unit 104 are together enclosed in a vacuum space formed by a glass housing 108. The degree of vacuum state required is $10_{-6}$–$10^{-7}$ torr. The lead wires 1 12 for the line electron source 102, gate 106, and light-emitting unit 104 protrude through the wire leading tube 110 on the back side of the glass housing 108.

Currently, the commercial large display screen for displaying animated images mainly employs small CRT and HVVFD, and since CRT and HVVFD are both vacuum devices, the rigidity of the glass structure used by both of them needs to be able to sustain atmospheric pressure. For example, the 80×80 $mm^2$ HVVFD needs at least a 2.8 mm thickness of glass in order to sustain atmospheric pressure. For this reason, there is a 5.6 mm (2.8 mm×2) of edge space for each device that must be excluded from the image display; therefore, the resolution of the display device is limited.

Another limitation is the way in which wires for the electrodes exit the glass housing. Because CRT uses the electron gun scanning method, only several electrodes need exit from the electron gun since the electrodes are simple in disposition. But since the HVVFD uses an X, Y matrix drive, the number of electrodes required is at least the sum total of X and Y, and if these electrodes were to exit, the space to be excluded for display would cover all the space occupied by the electrodes. The wire exiting method of today's commercial HVVFD is to bring the wires out from the base glass plate by drilling holes in the base glass plate instead of allowing the wires to protrude through the edges of the device. In this case, the process of drilling holes through the glass is rather difficult and complicated. In the meantime, in order to preserve the vacuum state of the device, the areas where wires exit must be sealed with special material employing special techniques. This makes the fabrication difficult and expensive. Additionally, the number of X and Y drives is limited; if not, the base plate with a large number of holes would cause difficulty during element printing on the base plate.

SUMMARY OF THE INVENTION

It is therefore an objective of the present invention to provide a structure of a vacuum display device that can use a relatively thin plate of glass, while simultaneously making use of a reinforced structural design to increase the rigidity of the glass housing in order to sustain a high pressure.

It is another objective of the present invention to provide a structure of a vacuum display device that allows the wire electrodes to exit through the edges of the device in order to reduce the thickness at the edges and simultaneously simplify the fabrication process.

In accordance with the foregoing and other objectives of the present invention, a structure of a vacuum display device is provided. The structure mainly comprises a vacuum chamber, the enclosure of which is formed by a surface plate, a base plate, and a spacer plate. The surface plate includes a display matrix and a black matrix and the base plate includes an inner surface and an outer surface, the base plate possesses a plurality of recesses in its edges. The required electrode lead wires are disposed on the inner surface of the base plate and extended out through the recesses. A multiple number of fins are disposed on the spacer plates to support the surface plate, the base plate, and the spacer plate, and are located at the black matrices. Additionally, a sealing material is used to seal the connecting edges between the surface plate, the base plate, and the spacer plate, and is also used to fill the gaps in the recesses.

According to a preferred embodiment of the present invention, fins are used to reinforce the structure of the vacuum device so that the thickness of the spacer plates can be reduced to leave more room for increasing the resolution when the device is fabricated. Moreover, since the electrode wires exit through recesses at the edges of the base plate, it is not necessary to increase the thickness of the spacer plates for the wiring. This also simplifies the fabrication.

BRIEF DESCRIPTION OF DRAWINGS

The invention can be more fully understood by reading the following detailed description of the preferred embodiment, with reference made to the accompanying drawings as follows.

DETAILED DESCRIPTION OF PREFERRED EMBODIMENT

Figure 1:
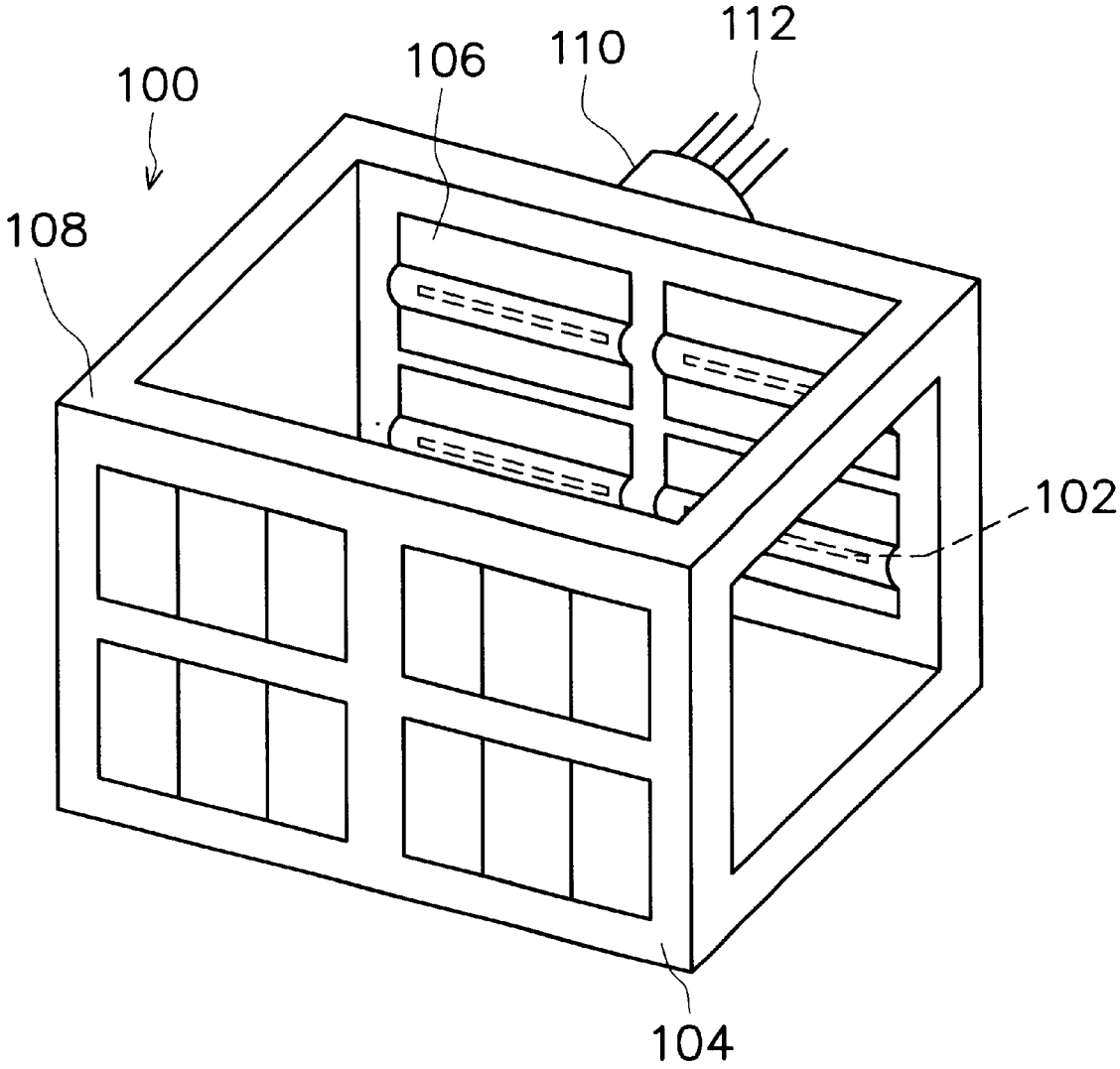
FIG. 1 (PRIOR ART)
FIG. 1 is a perspective view of the high voltage vacuum fluorescent display of the prior art.
Figure 2:
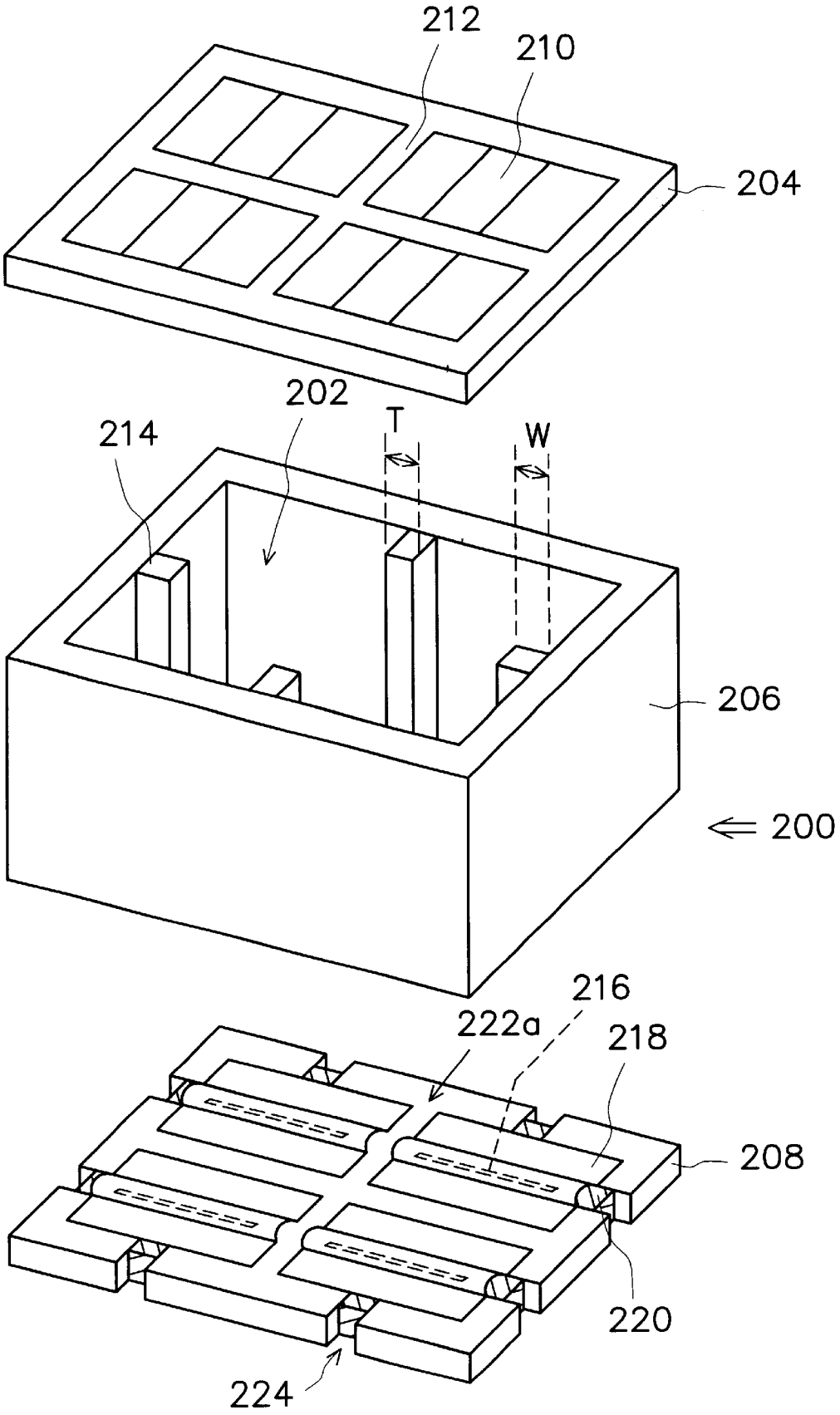
FIG. 2 is an exploded view of the vacuum display device structure in accordance with a preferred embodiment of the present invention.

FIG. 2 illustrates an exploded view of a structure of a vacuum display device according to the preferred embodiment of the present invention. Referring to FIG. 2, the vacuum display device 200 is constructed in a vacuum chamber 202. The vacuum chamber 202 is formed by a surface plate 204, a spacer plate 206, and a base plate 208, which are made of material such as glass. The sealing material (not shown) for sealing the connections between them includes a polymer sealing material (e.g. epoxy), a ceramic material, etc. The surface plate 204 is divided into a display matrix 210 having its inner surface coated with a fluorescent powder, and a black matrix used for the purpose of enhancing contrast, wherein the display matrix, for example, consists of three different display fluorescent powder matrix blocks: red, green, and blue.

Fins 214 are set up on the spacer plate 206 at locations corresponding to that of the black matrices 212 to reinforce the force-sustaining structure of the vacuum chamber 202. The vacuum chamber 202 is subjected to the atmosphere pressure from all directions as well as other external pressures, including mainly an upper pressure from the surface plate 204, a lower pressure from the base plate 208, and a side pressure from the spacer plates 206. As far as the upper and lower pressures are concerned, the spacer plate 206 can be reinforced by increasing the width W of the fins 214. For example, by using a 1.7 mm wide reinforced fin 214, the thickness of the spacer plates can be reduced from 2.8 mm to 1.1 mm. For sustaining side pressure, the thickness T of the fins 214 can be increased to achieve the object of reinforcing the spacer plates 206. The use of fins 206 will not block the emission range of the device since fins 214 are set up at locations corresponding to those of the black matrices. The fins 214 can be attached to the spacer plates 206 by a physical connection such as channel fitting, or by using an adhesive material such as glass or ceramic material. The spacer plates 206 and the fins 214 may even be integrally formed, wherein fins 214 can be made of glass or ceramic material. If ceramic material is used, a surface treatment process is performed; for example, the fins are coated with a glaze in order to seal any gaps and to assure the existence of a vacuum.

Figure 3:
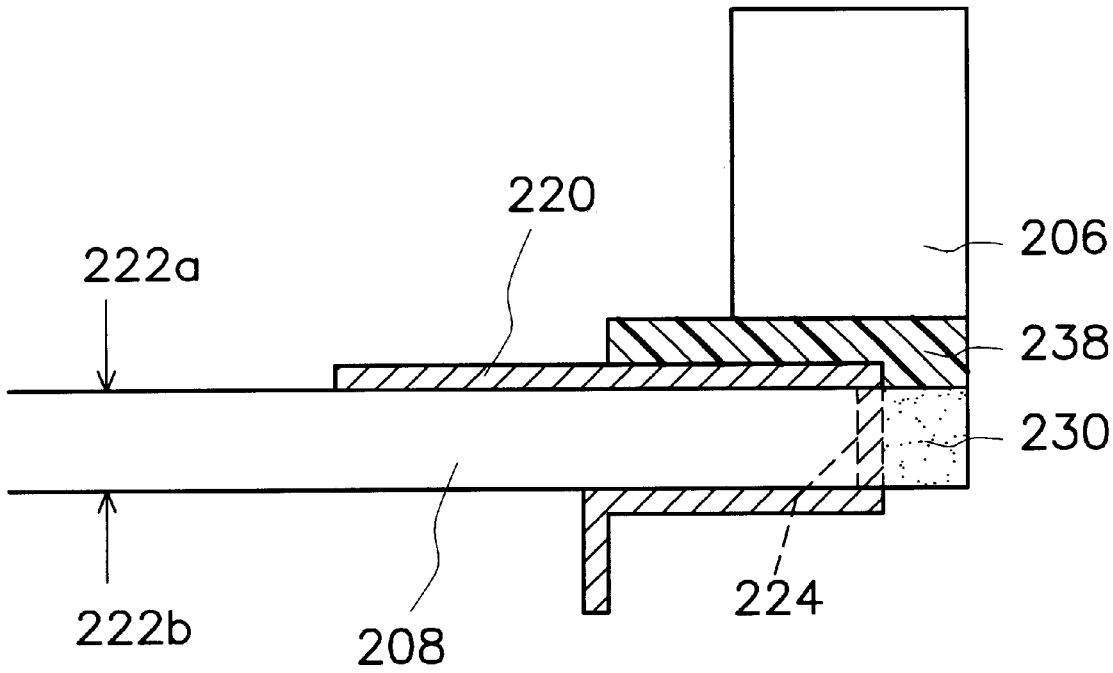
FIG. 3 and FIG. 4 are partial cross-sectional views of the vacuum display device structure of the present invention.
Figure 4:
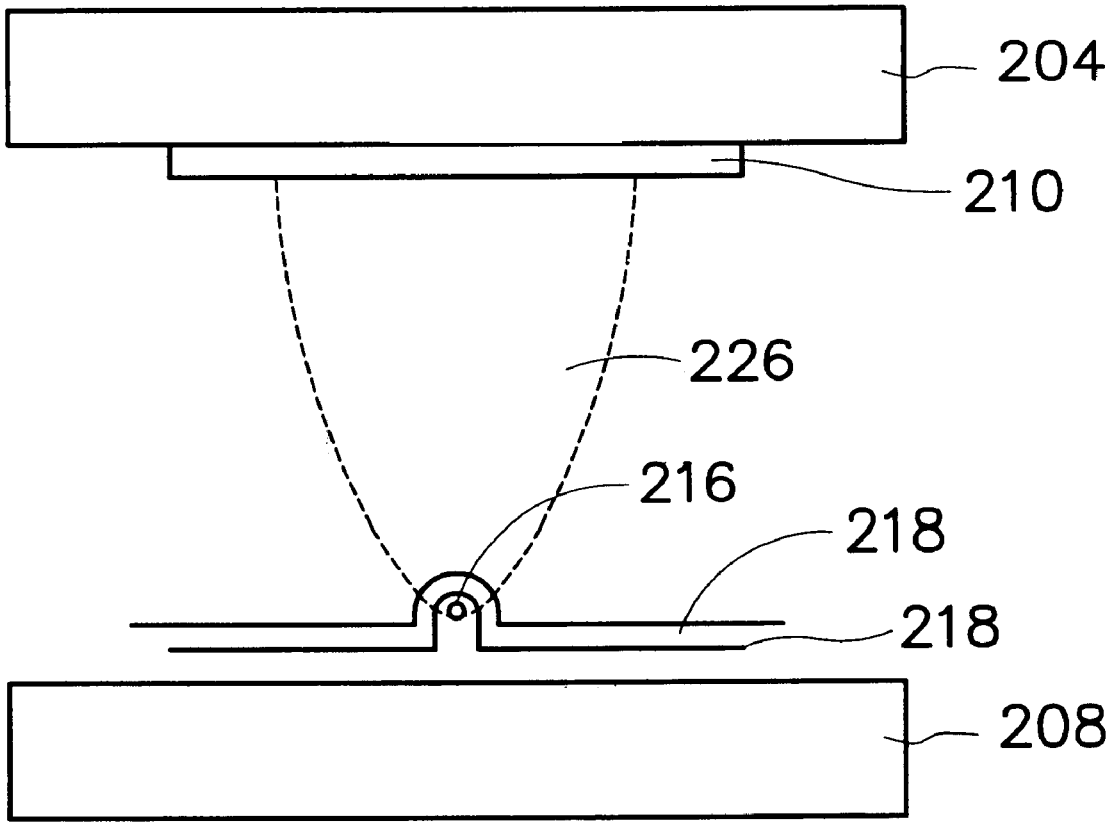

FIG. 3 and FIG. 4 are partial cross-sectional views of the vacuum display device of the present invention. The base plate 208 comprises an inner surface 222*a* and an outer surface 222*b*. An electron source 216 and a grid 218 having the required electrode lead wires 220, including power wire and control circuit, are set up on the inner surface 222*a*. A thin tungsten filament coated with oxide is liable to emit electrons. As shown in FIG. 4, through the acceleration and control of the grid 218, the thermoelectrons 226, which are emitted from the electron source 216 such as a thin tungsten filament, bombard the fluorescent powder in the display matrices 210 of the surface plate 204 and thus make the surface plate 204 luminous. The electron source 216 is not limited to the linear type; it can be a planar type of electron source, as well. The material of the base plate 208 can be glass, for example, while the power circuit or control circuit of the electron source 216 and gate 218 include the electrode 220 on the base plate 208. The electrode lead wire 220 made of copper, for example, can be printed on the base plate 208 by non-plating and photolithographic etching, or can be formed by pressing. A multiple number of recesses 224 are formed in the edges of the base plate 208 to facilitate the outward extension of the electrode lead wire 220. As shown in FIG. 3, the electrode lead wire 220 goes along the edge of the base plate 208 through the recesses 224 to the outer surface 222*b* in order to connect to the outside power source and signal.

The ways of forming recesses 224 include water cutting, sand blasting, die casting, etc. Therefore, the present invention provides a convenient and fast way to work on material and does not require a complicated working process such as drilling, glass melting, sealing, etc. on the base plate 208. The present invention can thus increase the yield of the manufacturing process. When it comes to fabrication, the base plate 208 and spacer plate 206 make use of sealing material 228 to fill the gap between them. The sealing material 228 includes frit, sealing ceramic material, and polymer sealing material. As for the area in the recesses 224, an insulated sealing material 230 is preferably used to fill the gap so as to protect the electrode lead wire 220 from being exposed to the surroundings. Besides, the insulated sealing material 230 can provide a good insulation medium when more than one electrode lead wire 220 passes through a recess 224 or an electrode lead wire 220 is combined with some other electronic elements. The insulated sealing material 230 such as epoxy is used to provide electrodes with protection. As the electrode lead wires 220 do not occupy extra peripheral width, the image display area can be increased, while the number of ports for the electrodes can be increased without increasing the edge thickness, which enables even more precise drive control; thereby, the resolution of the vacuum display device can be increased.

Although a high voltage vacuum fluorescent display (HVVFD) is provided as a preferred embodiment as mentioned above, those who are skillful in this technique should know that the fin structure disclosed by the present invention can also be applied in a vacuum display device such as the cathode ray tube (CRT), the vacuum fluorescent display, the field emitted display, the planar field emitted display, etc., or even in a non-display vacuum tube, to reinforce the rigidity of the vacuum structure. The structure of the electrode lead wire can also be applied in the above-mentioned devices to simplify the space disposition of the vacuum devices, as well as to simplify the working process of extending the lead wires out of the vacuum chamber; thereby, the device of the present invention can increase the yield.

To summarize the foregoing statement, the structure of the vacuum display device comprises at least the following advantages:

1. The vacuum device structure of the present invention can make use of the reinforced fin structure design to allow use of a relatively thin plate so as to increase the pressure-resistant strength of the plate housing. Therefore, the edge thickness can be reduced when it is used in a vacuum display device to provide more area for increasing the overall resolution after fabrication.
2. The set-up of recesses at the connecting edges for leading the electrode lead wire can simplify the space disposition, reduce the edge thickness, and improve the working process methods to result in a high yield, all of which increases the overall resolution after fabrication.

The invention has been described using an exemplary preferred embodiment. However, it is to be understood that the scope of the invention is not limited to the disclosed embodiment. On the contrary, it is intended to cover various modifications and similar arrangements. The scope of the claims, therefore, should be accorded the broadest interpretation so as to encompass all such modifications and similar arrangements.

What is claimed is:

1. A structure of a vacuum display device, comprising:

a vacuum chamber, comprising an enclosure formed by a surface plate, a base plate, and at least a spacer plate, wherein the surface plate has a plurality of display matrices and a plurality of black matrices, the base plate has an inner surface and an outer surface, and an edge of the base plate has a plurality of recesses therein;

a plurality of electrode lead wire disposed on the inner surface and extended through the recesses towards the outer surface;

a plurality of fins, disposed on the spacer plates of the vacuum chamber to sustain the surface plate, the base plate and the spacer plates, wherein the fins are positioned in the black matrices; and a sealing material, for sealing connections between the surface plate, the base plate, and the spacer plate and to fill gaps in the recesses.

2. The vacuum display device of claim 1, further comprising:

a plurality of electron sources, disposed on the inner surface;

a plurality of grids, disposed at respective electron sources; and a plurality of anodes, disposed on the surface plate;

wherein the electron sources, the grids, and the anodes are electrically connected to the electrode lead wires, respectively.

3. The vacuum display device of claim 1, wherein a material for the fins is chosen from a group consisting of glass and ceramic material.

4. The vacuum display device of claim 1, wherein the fins are fixed between the spacer plates, the surface plate, and the base plate by physical channel fitting.

5. The vacuum display device of claim 1, wherein the fins are fixed between the spacer plates, the surface plate, and the base plate by surface mounted glue.

6. The vacuum display device of claim 1, wherein the fins and the spacer plates are integrally formed.

7. The vacuum display device of claim 6, wherein the fins and the spacer plates comprise a ceramic material processed by a surface treatment which comprises glass material.

8. The vacuum display device of claim 6, wherein the fins and the spacer plates comprise a ceramic material processed by a surface treatment which comprises glazed material.

9. The vacuum display device of claim 1, wherein the sealing material is chosen from a group consisting of polymer insulated material and ceramic insulated material.

10. The vacuum display device of claim 5, wherein the fins are bonded to the spacer plates, the surface plate, and the base plate by glass material.

11. The vacuum display device of claim 5, wherein the fins are bonded to the spacer plates, the surface plate, and the base plate by ceramic material.

12. A structure of a vacuum display device, at least comprising:

a vacuum chamber, comprising an enclosure formed by a surface plate, a base plate, and at least a spacer plate;

a plurality of fins, disposed on the spacer plate of the vacuum chamber to sustain the surface plate, the base plate and the spacer plates; and a sealing material, for sealing connections between the surface plate, the base plate, and the spacer plate.

13. The vacuum display device of claim 10, wherein a material of the fins is chosen from a group consisting of glass and ceramic material.

14. The vacuum display device of claim 10, wherein the fins are fixed between the spacer plates, the surface plate, and the base plate by physical channel fitting.

15. The vacuum display device of claim 10, wherein the fins are fixed between the spacer plates, the surface plate, and the base plate by surface mounted glue.

16. The vacuum display device of claim 10, wherein the fins and the spacer plates are integrally formed.

17. The vacuum display device of claim 14, wherein the fins and the spacer plates comprise a ceramic material processed by a surface treatment which comprises glass material.

18. The vacuum display device of claim 14, wherein the fins and the spacer plates comprise a ceramic material processed by a surface treatment which comprises glazed material.

19. The vacuum display device of claim 10, wherein the sealing material is selected from a group consisting of polymer insulated material and ceramic insulated material.

20. The vacuum display device of claim 13, wherein the fins are bonded to the spacer plates, the surface plate, and the base plate by a material selected from a group consisting of glass and ceramic material.

21. The vacuum display device of claim 10, wherein the vacuum device is a vacuum device selected from group composed of a cathode ray tube, a vacuum fluorescent tube, a field emitted display, a plan field emitted display, and a vacuum tube.

22. A structure of a vacuum device, comprising:

a vacuum chamber, comprising an enclosure formed by a surface plate, a base plate, and at least a spacer plate, wherein the base plate has an inner surface and an outer surface, and an edge of the base plate also has a plurality of recesses therein;

a plurality of electrode lead wire disposed on the inner surface and extending through the recesses toward the outer surface; and a sealing material, for sealing connections between the surface plate, the base plate, and the spacer plate and to fill gaps in the recesses.

23.The vacuum device of claim 19, further comprising:

a plurality of electron sources, disposed on the inner surface;

a plurality of grids, disposed at respective electron sources; and a plurality of anodes, disposed on the surface plate;

wherein the electron sources, the grids, and the anodes are electrically connected to the electrode lead wires, respectively.

24. The vacuum display device of claim 19, wherein the sealing material is chosen from a group consisting of polymer insulated material and ceramic insulated material.

25. The vacuum display device of claim 10, wherein the vacuum device is a vacuum device selected from group composed of a cathode ray tube, a vacuum fluorescent tube, a field emitted display, a planar field emitted display, and a vacuum tube.

* * * * *